US005691743A

United States Patent [19]

Kusano

[11] Patent Number: 5,691,743

[45] Date of Patent: Nov. 25, 1997

[54] IMAGE DISPLAY DEVICE

[75] Inventor: Satoshi Kusano, Tokorozawa, Japan

[73] Assignee: Pioneer Electronic Corporation, Tokyo-to, Japan

[21] Appl. No.: 559,571

[22] Filed: Nov. 16, 1995

[30] Foreign Application Priority Data

Nov. 18, 1994 [JP] Japan ..... 6-285488

[51] Int. Cl.[6] ..... G09G 5/34

[52] U.S. Cl. ..... 345/123; 345/189

[58] Field of Search ..... 345/123, 124, 345/125, 118, 189

[56] References Cited

U.S. PATENT DOCUMENTS 5,053,761 10/1991 Webster, III ..... 345/123
5,208,588 5/1993 Nishiyama ..... 345/123

*Primary Examiner*—Mark R. Powell
*Assistant Examiner*—Matthew Luu
*Attorney, Agent, or Firm*—Finnegan, Henderson, Farabow, Garrett & Dunner, L.L.P.

[57] ABSTRACT

An image display device includes: a first memory for storing an image data; transmitting unit for reading out a portion of the image data stored in the first memory from a position of a transmitting side address and transmitting the read image data; a second memory for receiving the image data from the transmitting unit and storing the transmitted image data from a position of a receiving side address, the second memory renewing the stored image data endlessly by cyclicly changing the receiving side address and overwriting the transmitted image data; a display unit for reading out the image data stored in the display memory from a position of a display start address and displaying the read image data on a screen thereof; scroll information receiving unit for receiving scroll information including a scroll direction and a scroll amount inputted by an operator; and control unit for determining the display start address, the receiving side address and the transmitting side address in accordance with the scroll information, the second memory having a storage capacity larger than a data capacity of image displayed on one screen of the display unit.

7 Claims, 6 Drawing Sheets

$X_R$=1408 (PIXELS)
$Y_R$=1152 (PIXELS)
$X_D$=1280 (PIXELS)
$Y_D$=1024 (PIXELS)

IMAGE DISPLAY DEVICE

BACKGROUND OF THE INVENTION

1. Field of the Invention

This invention relates to an image display device, and more particularly to a screen scrolling technique of the image display device which displays a portion (window) of a large still image, especially drawn in a virtual space.

2. Description of the Prior Art

An image display system utilizing a computer, such as a CAD (Computer Aided Design) or a CG (Computer Graphics), enables handling an image larger than the screen size of the display device with the aid of the concept of virtual space. In order to create the image in the virtual space, a known image display device is provided with an image data memory of large capacity for storing the data of the large image which is drawn in the virtual space and read out from an external harddisk or the like, and a display memory of small capacity for storing the image data to be displayed on the monitor. On receiving the operator's instruction, a portion of the large image stored in the image data memory is transmitted to the display memory. Then, the image data stored in the display memory is read out and is displayed on the monitor in synchronism with the scanning period of the monitor, e.g., CRT. When the operator desires to watch the image around the partial image currently displayed on the monitor, he or she needs to instruct scrolling the screen in horizontal and/or vertical direction thereof. Namely, since the original image is so large and the monitor can display only a portion of the large image, the operator has to change the portion of the large image to be displayed on the monitor. This scroll operation is started when the operator inputs a direction, an amount and a speed of the scroll using a user-interface such as a mouse or a keyboard. Based on the inputted information relating to the screen scroll, the scrolled image data is displayed on the monitor in synchronism with the scanning period of the CRT. In parallel with this operation, still image data in the display memory, which becomes invisible due to the scroll of the screen, is replaced by new image data transmitted from the image data memory.

However, in the above-described image display device, the display memory has a storage capacity no more than a data capacity of one screen image of the CRT. Therefore, when the image data is read out from the display memory and is displayed synchronously with the scanning of the CRT, the renewed image data appears on the screen due to the scroll operation. As a result, the displayed image becomes discontinuous and gives the watcher a strange feeling. This will be described more specifically. The CRT displays video signal of 30 frames at every one seconds while the display memory renews the data by reading out the image data from the large image data memory, and hence the data renewal cannot be completed during the vertical blanking period of the video signal. In this view, the contents of the display memory where the data renewal is going on is displayed on the monitor, thereby making the displayed memory discontinuous.

SUMMARY OF THE INVENTION

It is an object of the present invention to provide an image display device capable of performing smooth scroll freely from the affection by the image data renewal.

According to one aspect of the present invention, there is provided an image display device including: a first memory for storing an image data; transmitting unit for reading out a portion of the image data stored in the first memory from a position of a transmitting side address and transmitting the read image data; a second memory for receiving the image data from the transmitting unit and storing the transmitted image data from a position of a receiving side address, the second memory renewing the stored image data endlessly by cyclicly changing the receiving side address and overwriting the transmitted image data; a display unit for reading out the image data stored in the display memory from a position of a display start address and displaying the read image data on a screen thereof; scroll information receiving unit for receiving scroll information including a scroll direction and a scroll amount inputted by an operator; and control unit for determining the display start address, the receiving side address and the transmitting side address in accordance with the scroll information, the second memory having a storage capacity larger than a data capacity of image displayed on one screen of the display unit.

In accordance with the image display device thus configured, the transmitting unit transmits a portion of the image stored therein to the second memory, and the second memory stores the transmitted image data. The display unit displays the image data stored in the second memory on a screen. When a user wish to scroll the displayed image, he or she inputs the scroll information including the scroll direction and amount. On receiving the scroll information, the control unit determines the receiving side address, the transmitting side address and the display start address in accordance with the inputted scroll information.

The nature, utility, and further features of this invention will be more clearly apparent from the following detailed description with respect to preferred embodiment of the invention when read in conjunction with the accompanying drawings briefly described below.

DESCRIPTION OF THE PREFERRED EMBODIMENT

A preferred embodiment of the present invention will be described below with reference to the accompanying drawings.

Figure 1:
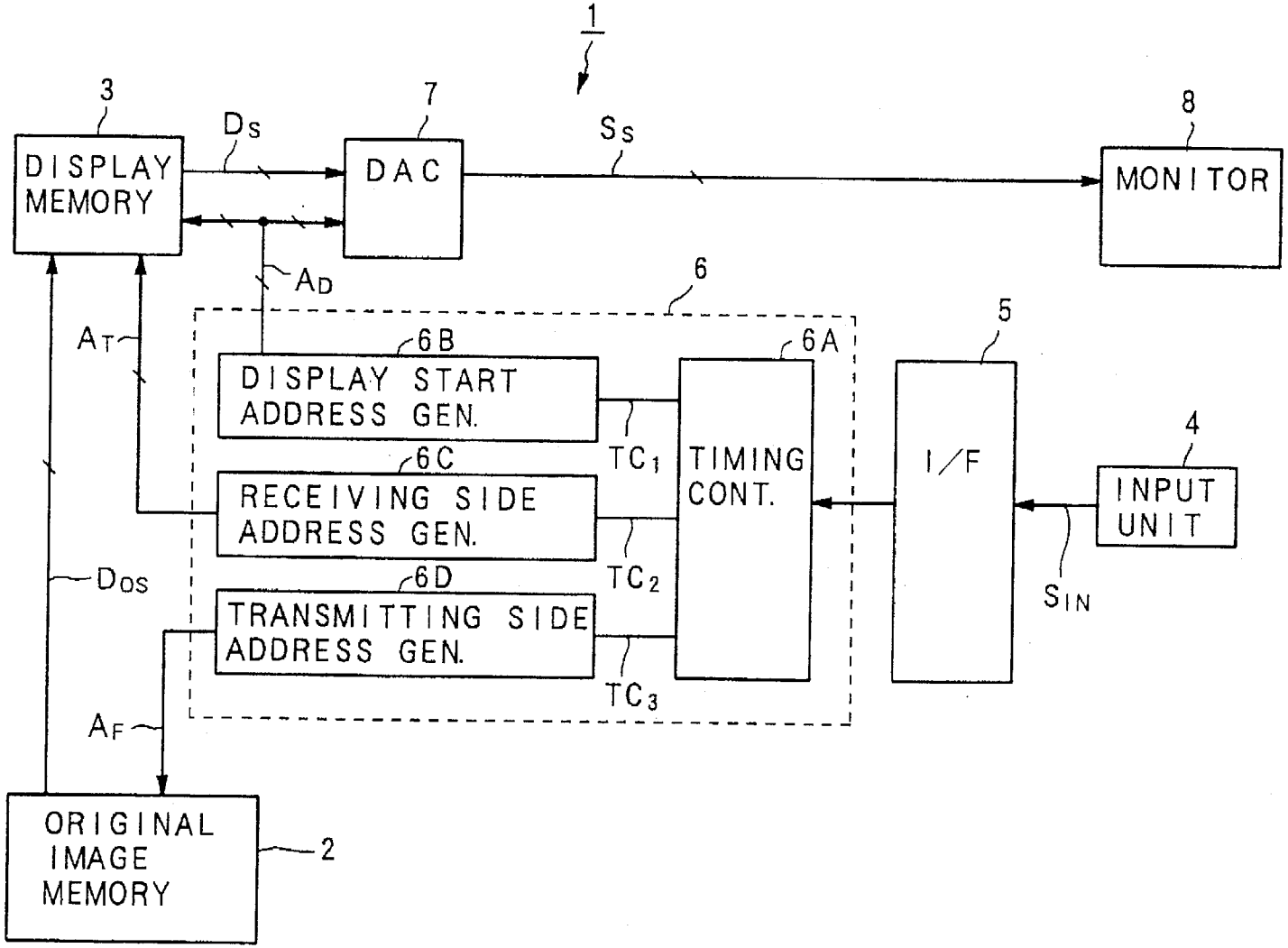
FIG. 1 is a block diagram illustrating a configuration of an image display device according to the present invention.

FIG. 1 illustrates a configuration of an image display device according to the present invention. As illustrated, the image display device 1 includes an original image memory 2, a display memory 3, an input unit 4, an interface 5, a Graphic System Processor (hereinafter referred to as "GSP") 6, a digital/analog converter (hereinafter referred to as "DAC") 7 and a monitor 8. The original image memory 2 stores image data $D_{OS}$ of a large still image $I_O$ drawn in a virtual space (hereinafter referred to as "original still image data $D_{OS}$"), and reads out and transmits the original still image data $D_{OS}$ from the storage area specified by the transmitting side address $A_F$. The original image memory 2 may preferably be a DRAM having large capacity. The display memory 3 stores the original still image data $D_{OS}$ transmitted from the original image memory 2 as still image data $D_S$ corresponding to a still image $I_D$ at the storage area specified by the receiving side address $A_T$. The display memory 3 needs to have a storage area larger than the storage area required to store one screen image on the monitor. For example, where the screen size of the monitor is 1280×1024 pixels, the display memory 3 needs to have a storage area size 1408×1152 pixels, that is, larger by 128 pixels than the screen size of the monitor in all directions. The input unit 4 may be constituted by a keyboard or a mouse, and the interface 5 supplies the signal $S_{IN}$ outputted from the input unit 4 to the GSP 6. The GSP 6 generates and outputs, based on the signal $S_{IN}$ from the interface 5, the display start address $A_D$, the receiving side address $A_T$ and the transmitting side address $A_F$. The DAC 7 conducts a digital-to-analog conversion onto the still image data $D_S$ outputted from the display memory 3, and outputs the converted data as a still image signal $S_S$. The monitor 8 displays the still image thereon based on the still image signal $S_S$.

The GSP 6 includes a timing controller 6A, a display start address generator 6B, a receiving side address generator 6C and a transmitting side address generator 6D. The timing controller 6A receives the signal $S_{IN}$ from interface 5, produces a first timing signal $TC_1$ for controlling the output timing of the display start address $A_D$, a second timing signal $TC_2$ for controlling the output timing of the receiving side address $A_T$ and a third timing signal $TC_3$ for controlling the output timing of the transmitting side address $A_F$. Then, the timing controller 6A supplies the first timing signal $TC_1$, the second timing signal $TC_2$ and the third timing signal $TC_3$ to the display start address generator 6B, the receiving side address generator 6C and the transmitting side address generator 6D, respectively. The display start address generator 6B receives the first timing signal $TC_1$, and generates the display start address $A_D$. The receiving side address generator 6C receives the second timing signal $TC_2$, and generates the receiving side address $A_T$. The transmitting side address generator 6D receives the third timing signal $TC_3$, and generates the transmitting side address $A_F$.

Figure 2A:
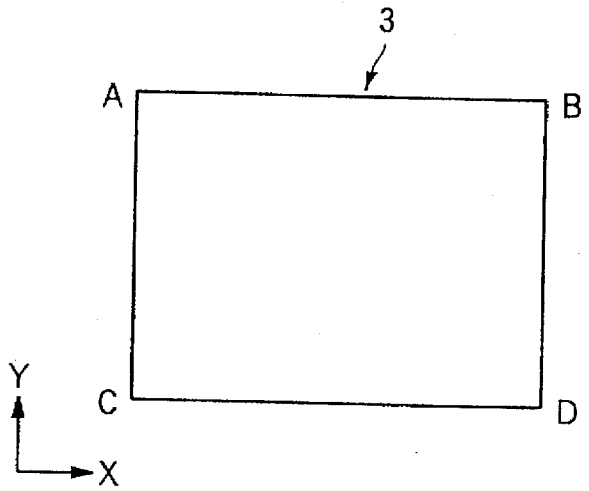
FIGS. 2A–2C are views schematically illustrating a concept of logical address structure of a display memory shown in FIG. 1.
Figure 2B:
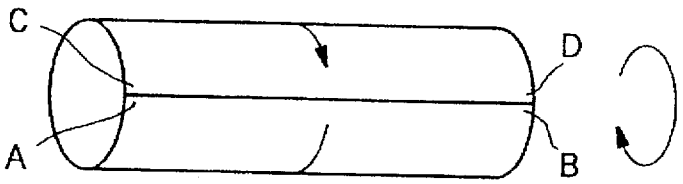
Figure 2C:
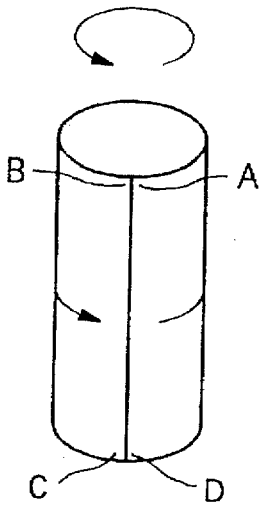

FIGS. 2A–2C schematically illustrate a concept of logical address structure of the display memory 3. The logical address of the display memory 3 is designed in a cyclic fashion. Namely, assuming that the display memory 3 has the rectangular storage area and its four corner points are expressed as A, B, C and D (see. FIG. 2A), the storage area is so configured that the points A and C and the points B and D are continuous in the Y-axis direction and that the points A and B and the points C and D are continuous in the X-axis direction, as illustrated in FIGS. 2B and 2C. Therefore, the still image data transmitted from the original image memory 2 may be endlessly written in the display memory by cyclicly changing the address and overwriting the stored image.

Figure 3A:
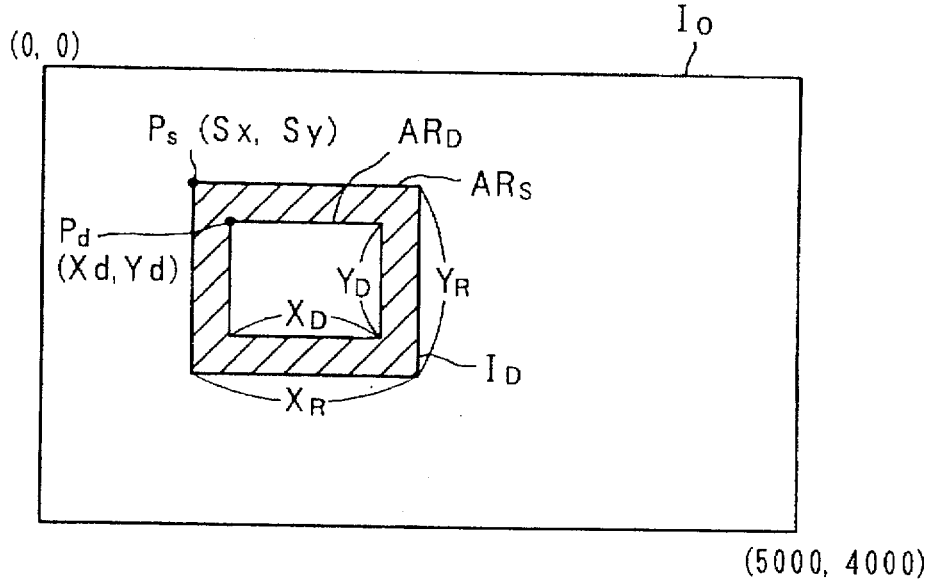
FIG. 3A is an explanatory diagram illustrating the relationship between the stored data of the original image memory and the display memory shown in FIG. 1.

FIG. 3A illustrates the relationship between the storage manners of the still image data in the original image memory 2 and the display memory 3. As shown in FIG. 3A, image data of one portion ($AR_S$ in this case) of the original image $I_O$ is stored in the display memory 3 as the image $I_D$, and only the image data of the center portion $AR_D$ of the image $I_D$, stored in the display memory 2 is displayed on the monitor 8. Namely, the image data in the hatched portion, inside of the area $AR_S$ and outside of the area $AR_D$, is stored in the display memory 3 but is not displayed on the monitor 8. In this example, it is assumed that the storage capacity of the original image memory 2 is approximately 60 Mbytes (5000×4000 pixels) for each colors Red, Green and Blue (in color display), the storage capacity of the display memory 3 is approximately 5 Mbytes (1408 [$=X_R$]×1152 [$=Y_R$] pixels), and the data capacity of one screen image of the monitor 8 is approximately 4 Mbytes (1280 [$=X_D$]×1024 [$=Y_D$] pixels).

Figure 3B:
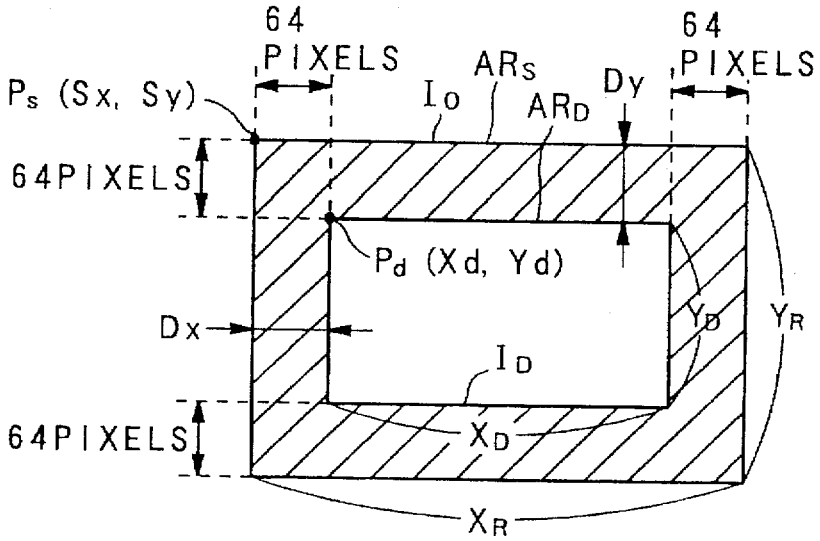
FIG. 3B is an explanatory diagram illustrating data areas of the display memory.

FIG. 3B illustrates data storage areas of the display memory 3. As shown in FIG. 3B, two data areas $AR_S$ and $AR_D$ are prescribed in the display memory 3. A portion of the data stored in the original image memory 2 is supplied to and stored in the display memory 3. The first data area $AR_S$ is a rectangular area having a horizontal length corresponding to $X_R$ pixels and a vertical length corresponding to $Y_R$ pixels from the first reference point $P_S(S_x, S_y)$. Within the first area $AR_S$, the second data area $AR_D$ is prescribed. The second area $AR_D$ is also a rectangular area whose horizontal length and vertical length are reduced by 64 pixels in all directions (four directions in this case), as shown in FIG. 3B. The second data area AR, has a horizontal length corresponding to $X_D$ pixels and a vertical length corresponding to $Y_D$ pixels from the second reference point $P_D(X_d, Y_d)$. Still image data stored within the second area $AR_D$ is displayed on the monitor 8, and the data area within the first area $AR_S$ and outside of the second area $AR_D$ (hatched area in FIG. 3B) is used for scroll processing. It is important to note that no new data is written in the second area $AR_D$ while the still image data within the second area $AR_D$ is being displayed.

As shown in FIG. 3A, still image data of the original image memory 2 within the first data area $AR_S$ is transmitted to and stored in the display memory 2. The location of the first area $AR_S$ within the storage area of the original image memory 2 is determined on the basis of the position of the first reference point $P_s(S_x, S_y)$ . This information may initially be inputted by the operator. When the first reference point $P_S(S_x, S_y)$ is determined, the second reference point $P_D(X_d, Y_d)$ is determined automatically as follows:

$$X_d=S_x+64, \text{ and } Y_d=S_y+64.$$

It is noted that the deviations Dx and Dy (see. FIG. 3B ) of the first reference point $P_S(S_x, S_y)$ and the second reference point $P_D(X_d, Y_d)$, i.e., 64 pixels in each horizontal and vertical directions in this case, are simply one example, and it may be altered in accordance with the scroll speed, i.e., ability of the image display device.

Figure 4A:
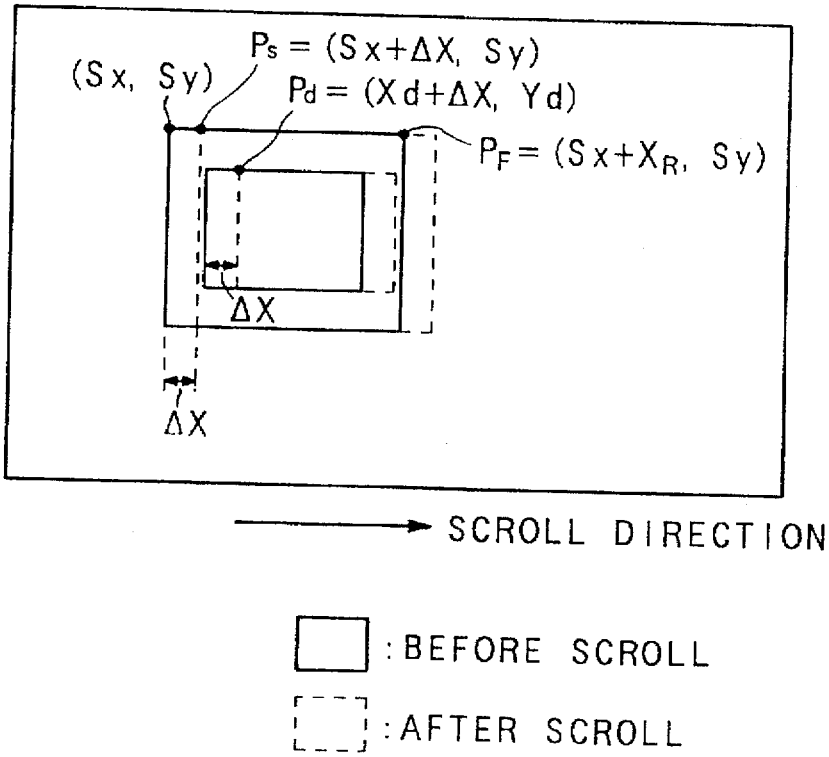
FIGS. 4A and 4B are explanatory diagrams illustrating the change of the stored data in the display memory.

Next, the scroll operation will be described. Now, it is assumed that the operator instructs scrolling the displayed image in right side of the virtual image $I_O$ stored in the original image memory 2 (see. FIG. 4A). This movement will be referred to as "the scroll in right direction". If the operator instructs the scroll in right direction by the scroll amount corresponding to 10 pixels, for example, the second data area $AR_D$ shifts right by 10 pixels, and the new image which has been in the hatched data area and been invisible appears for the width of 10 pixels. In this way, the screen scroll is performed. The scroll in lower side may be achieved by shifting the second data area $AR_D$ in the lower direction in the similar manner. However, in this invention, the shift range of the second data area $AR_D$ responsive to one scroll instruction is restricted within the hatched portion in FIG., 3A, that is, within the first data area $AR_S$. Namely, the scroll amount of one scroll operation is limited to be no more than the deviations Dx or Dy in all directions. Therefore, the second data area $AR_D$ does not shift beyond the previous first data area $AR_S$. As described above, the still image data has been stored in the first data area $AR_S$ in a continuous manner, and hence the second data area $AR_D$ moves within the area where the still image data has been already stored. In other words, the second data area $AR_D$ never enters the area where new still image data in the original image memory 2 is needed to be written due to the scroll. For this reason, it is possible to prevent the still image data under the data renewal from being displayed on the monitor 8.

Figure 4B:
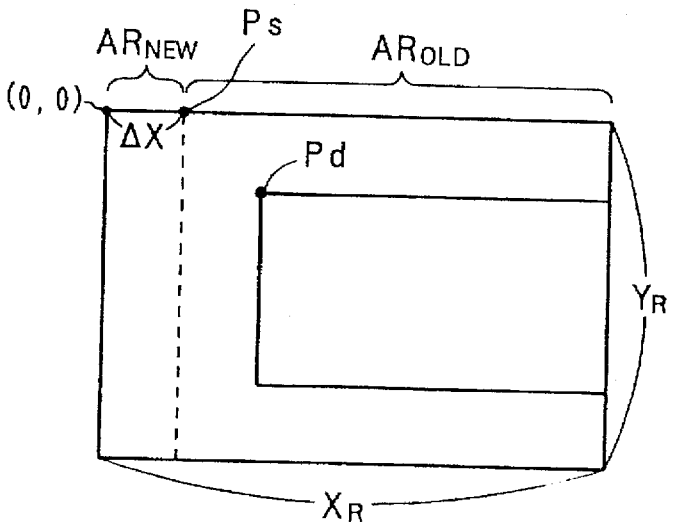
Figure 5:
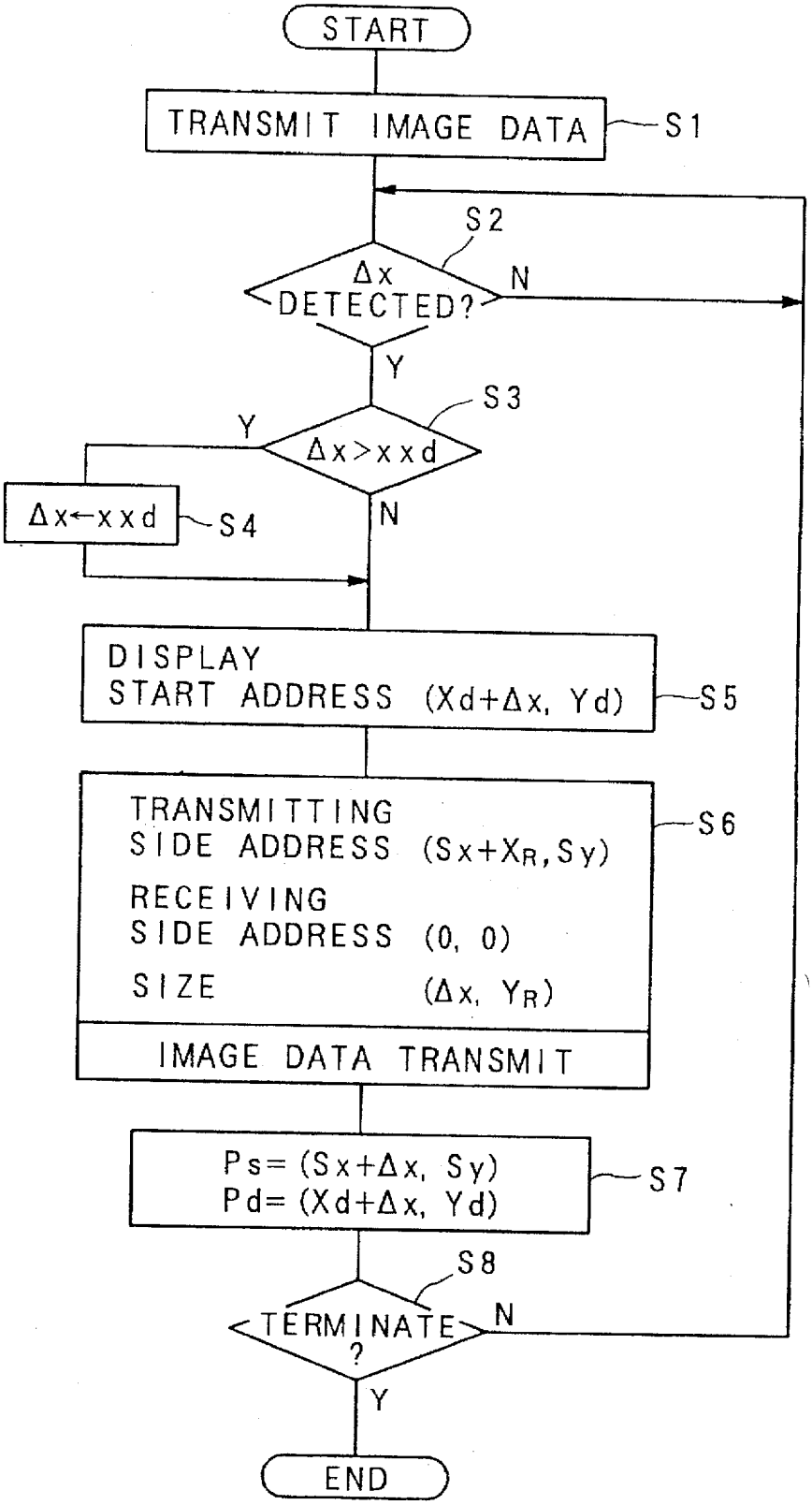
FIG. 5 is a flowchart illustrating the screen scroll operation of the image display device according to this invention.

Next, the screen scroll operation of the image display device according to this embodiment will be described with reference to FIGS. 3–5. The following description will be presented under the assumption that the operator instructs the scroll in right direction. It is also assumed that a mouse is used as the input unit 4. First, the GSP 6 controls the original image memory 2 to transmit the original still image data $D_{OS}$ to the display memory 3, and the display memory 3 stores the transmitted data as the still image data $D_S$ (step S1). Then, the GSP 6 Judges whether the movement amount $\Delta X$ of the mouse, serving as the input unit 4, is detected or not (step S2). The movement amount $\Delta X$ of the mouse is a scroll amount instructed by the operator. If step S2 results in No, step S2 is repeated until it results in Yes. If step S2 results in Yes, then it is judged whether the scroll amount $\Delta X$ is larger than a maximum scroll amount xxd or not (step S3). The maximum scroll amount is determined in advance to be no more than the deviation Dx shown in FIG. 3B, i.e., 64 pixels in this case. If step S3 results in No, the process goes to step S5 directly. On the other hand, if step S3 results in Yes, the maximum scroll amount xxd is set to the scroll amount $\Delta X$ (step S4). Then, the display start address generator 6B sets the display start address $A_D=(X_d+\Delta x, Y_d)$ (step S5). Then, the transmitting side address generator 6D sets the transmitting side address $A_F=(S_X+X_R, S_Y)$ and the transmitted data size $V=(\Delta x, Y_R)$. The receiving side address generator 6C sets the receiving side address $A_T=(0, 0)$. Then, the GSP 6 starts transmission of the rectangular still image data from the original still image memory 2 to the display memory 3 (step S6). As a result, the image data to be displayed on the monitor 8 shifts right by $\Delta x$ as shown in FIG. 4A (dotted area), and new original still image data $D_S$ is transmitted to the display memory 3 and stored in the area $AR_{NEW}$ shown in FIG. 4B. On the other hand, no new image data is written and old image data is retained within the area $AR_{OLD}$.

Subsequently, the first reference point $P_S$ of the first data area $AR_S$ is renewed as: $P_S=(S_x+\Delta x, S_y)$, and the second reference point $P_d$ of the second data area $AR_D$ is renewed as: $P_d=(X_d+\Delta x, Y_d)$. Then, the still image is displayed on the monitor 8 using the renewed data (step S7). Then, it is judged whether the process is to be terminated or not (step S8). If Yes, the process ends. If step S8 results in No, then the process returns to step S2 to repeat steps S2 to S8.

As described above, according to this embodiment, the still image data under the data renewal is not displayed, and therefore it is possible to avoid the display of discontinuous image due to the screen scroll.

Figure 6:
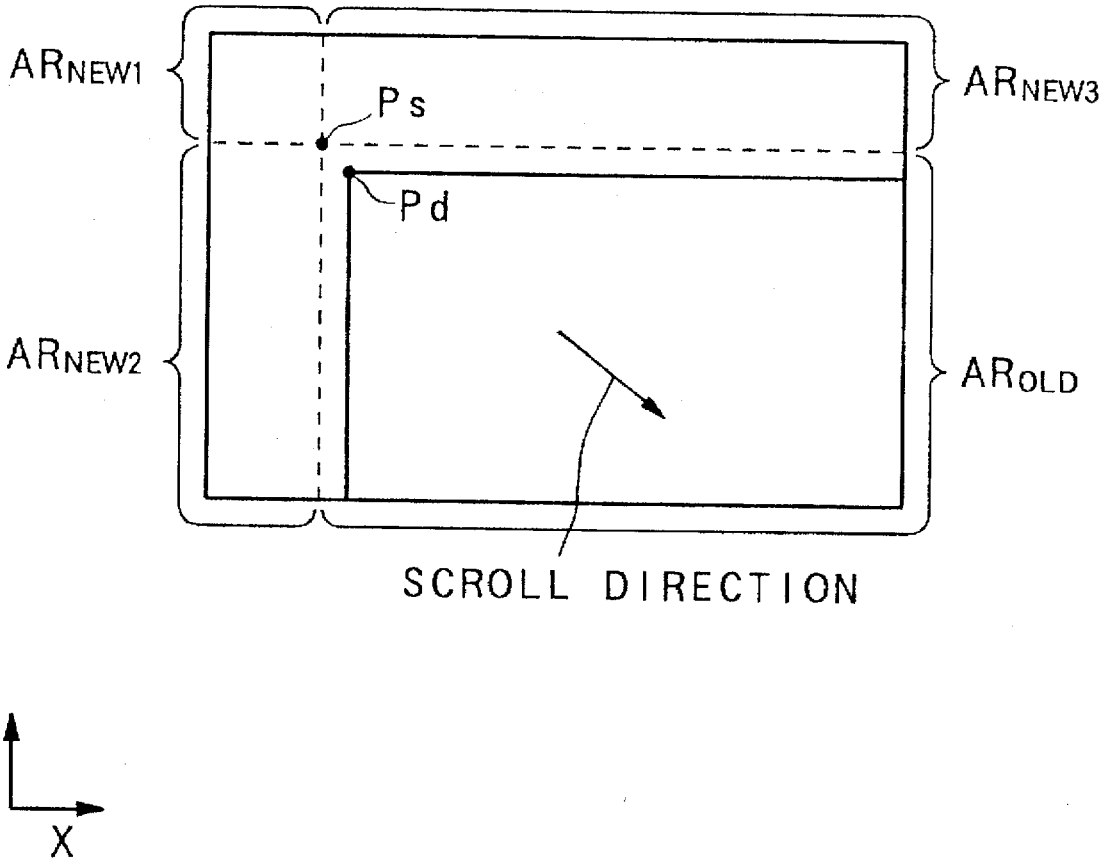
FIG. 6 is an explanatory diagram illustrating the data renewal manner of the display memory in a case where the scroll is performed in the oblique direction.

FIG. 6 illustrates the data storage manner of the display memory 2 in a case where the scroll is performed in the oblique direction. When the scroll is performed in the oblique direction, as shown in FIG. 6, the above described operation is performed in both X- and Y-directions successively, and new original still image data $D_{OS}$ is transmitted and written in the areas $AR_{NEW1}$–$AR_{NEW3}$. On the other hand, the old image data is maintained in the area $AR_{OLD}$.

As described above, according to the present invention, the display memory has a larger capacity than the data capacity of one screen image and the shift range of one scroll operation is limited within the range of the storage area of the display memory. Therefore, the still image under the data renewal due to the scroll Operation is not displayed, thereby preventing the operator from seeing discontinuous image during the scroll operation.

The invention may be embodied on other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning an range of equivalency of the claims are therefore intended to be embraced therein.

What is claimed is:

1. An image display device comprising:

a first memory for storing an image data;

transmitting means for reading out a portion of the image data stored in the first memory from a position of a transmitting side address and transmitting the read image data;

a second memory for receiving the image data from the transmitting means and storing the transmitted image data from a position of a receiving side address, said second memory renewing the stored image data endlessly by cyclicly changing the receiving side address and overwriting the transmitted image data;

a display means for reading out the image data stored in said display memory from a position of a display start address and displaying the read image data on a screen thereof;

scroll information receiving means for receiving scroll information including a scroll direction and a scroll amount inputted by an operator; and control means for determining the display start address, the receiving side address and the transmitting side address in accordance with the scroll information, said second memory having a storage capacity larger than a data capacity of image displayed on one screen of said display means.

2. An image display device according to claim 1, wherein said second memory comprises a main data area having a storage area corresponding to a data amount of one screen image of the display means, and an additional data area surrounding the main data area and having storage areas of a predetermined data amount in all directions of the main data area.

3. An image display device according to claim 2, wherein said main data area comprises a rectangular storage area, and said additional data area is provided in four directions of said main data area outside thereof.

4. An image display device according to claim 1, wherein said control means determines the display start address by adding the scroll amount, according to the scroll direction, to the display start address before the scroll amount is inputted.

5. An image display device according to claim 1, wherein said control means comprises changing means for replacing the scroll amount by a maximum scroll amount when the scroll amount is larger than the maximum scroll amount.

6. An image display device according to claim 2, wherein said control means comprises changing means for replacing the scroll amount by a maximum scroll amount when the scroll amount is larger than the maximum scroll amount.

7. An image display device according to claim 6, wherein said maximum scroll amount substantially equals to the predetermined data amount of the storage area of the additional data area.

* * * * *